US006135613A

United States Patent [19]

Bodell et al.

[11] Patent Number: 6,135,613

[45] Date of Patent: Oct. 24, 2000

[54] LIGHTING FIXTURE ASSEMBLY SEALED AT OPPOSITE ENDS WITH DUST COVERS

[75] Inventors: Steven W. Bodell, Troutville; Stephen M. Stafford, Radford, both of Va.

[73] Assignee: Hubbell Incorporated, Orange, Conn.

[21] Appl. No.: 09/099,804

[22] Filed: Jun. 18, 1998

[51] Int. Cl.[7] ..... F21V 7/00

[52] U.S. Cl. ..... 362/223; 362/224; 362/267; 362/375; 362/376; 362/217

[58] Field of Search ..... 362/223, 224, 362/267, 375, 376, 217

[56] References Cited

U.S. PATENT DOCUMENTS 4,580,200 4/1986 Hess et al. ..... 362/223

FOREIGN PATENT DOCUMENTS 0054595 6/1982 European Pat. Off. ..... F21S 3/02

*Primary Examiner*—Stephen Husar
*Assistant Examiner*—Anabel M Ton
*Attorney, Agent, or Firm*—Jerry M. Presson; Michael R. Swartz

[57] ABSTRACT

A lighting fixture assembly includes a lighting fixture having a mounting member, a pair of end plates, an elongated lamp and an elongated lens, and a pair of dust covers fittable over opposite ends of the lighting fixture. Each end plate is mounted to one of the opposite end of the mounting member and is substantially comprised of a first material having a first coefficient of thermal expansion. The lamp is mounted adjacent to the mounting member and extends between the end plates and has opposite ends disposed adjacent to the end plates. The lens is mounted adjacent to the mounting member and extends between the end plates and has opposite ends disposed adjacent to the end plates. The lens together with the mounting member and end plates substantially encloses the lamp. The lens is substantially comprised of a second material having a second coefficient of thermal expansion different from the first coefficient of thermal expansion of the first material of the end plates such that when the lens and end plates are heated during illumination of the lamp a difference in expansion of the second material of the lens and the first material of the end plates occurs creating gaps between the opposite ends of the lens and end plates. Each dust cover securably fits over one of the end plates, one of the opposite ends of the mounting member and one of the opposite ends of the lens for covering the gaps therebetween and thereby sealing the assembly at the locations of the gaps to prevent foreign matter from entering the assembly through the gaps.

12 Claims, 5 Drawing Sheets

LIGHTING FIXTURE ASSEMBLY SEALED AT OPPOSITE ENDS WITH DUST COVERS

BACKGROUND OF THE INVENTION

1. Field of the Invention

The present invention generally relates to lighting fixtures and, more particularly, is concerned with a lighting fixture assembly sealed at opposite ends with a pair of dust covers.

2. Description of the Prior Art

Fluorescent lighting fixtures are used in a variety of different settings. These fixtures often include a mounting member, a pair of end plates mounted at opposite ends of the mounting member, an elongated lamp extending between and mounted at opposite ends adjacent to the end plates, and an elongated lens extending between the end plates and mounted to at least one of the end plate and the mounting member and substantially surrounding the lamp. The lens and end plates are often comprised of different materials which have different coefficients of thermal expansion such that, when the lens and end plates are heated during illumination of the lamp, a difference in expansion of the two materials occurs creating a gap between the opposite ends of the lens and end plates. Foreign matter, such as dust particles, may pass through the gap and accumulate inside of the lens and cause deterioration of the lamp or otherwise degrade the performance of the lighting fixture.

Consequently, a need exists for an assembly which provides a solution to the aforementioned problem in the prior art without introducing any new problems in place thereof.

SUMMARY OF THE INVENTION

The present invention provides a lighting fixture assembly which is designed to satisfy the aforementioned need. The lighting fixture assembly of the present invention includes a lighting fixture and a dust cover for enclosing and sealing a gap which may form between at least one of the opposite ends of an elongated lens and at least one of the end plates of the lighting fixture. The dust cover of the assembly prevents foreign matter, such as dust particles, from passing through the gap and accumulating inside of the lens causing damage to the lighting fixture.

Accordingly, the present invention is directed to a lighting fixture assembly which comprises: (a) a lighting fixture including (i) a mounting member having a pair of opposite ends, (ii) a pair of end plates each mounted to one of the opposite ends of the mounting member and being substantially comprised of a first material having a first coefficient of thermal expansion, (iii) an elongated lamp mounted adjacent to the mounting member and extending between the end plates, the lamp having opposite ends disposed adjacent to the end plates, and (iv) an elongated lens mounted adjacent to the mounting member and extending between the end plates, the lens having opposite ends disposed adjacent to the end plates and together with the mounting member and end plates substantially enclosing the lamp, the lens being substantially comprised of a second material having a second coefficient of thermal expansion different from the first coefficient of thermal expansion of the first material of the end plates such that when the lens and end plate are heated during illumination of the lamp a difference in expansion of the second material of the lens and the first material of the end plate occurs creating a gap between at least one of the opposite ends of the lens and at least one of the end plates; and (b) a dust cover securably fittable over the one of the end plates, one of the opposite ends of the mounting member and the one of the opposite ends of the lens for covering the gap therebetween and thereby sealing the assembly at the location of the gap to prevent foreign matter from entering the assembly through the gap. The assembly may comprise a pair of the dust covers securably fittable over both end plates and both opposite ends of the mounting member and of the lens of the lighting fixture.

The first material of the end plate is metal. The second material of the lens is plastic. The dust cover is comprised of a substantially flexible polymeric material, such as rubber. The dust cover includes a main wall having a pair of opposite faces and a periphery encompassing the faces, and a flange attached to and extending about the periphery of the main wall and extending away from one of the faces thereof so as to define a cavity for receiving therein the one of the end plates, the one of the opposite ends of the mounting member and the one of the opposite ends of the lens of the lighting fixture. The one of the end plates, the one of the opposite ends of the mounting member and the one of the opposite ends of the lens together have a first configuration. The dust cover has a second configuration conforming to the first configuration of the mounting member, end plate and elongated lens.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
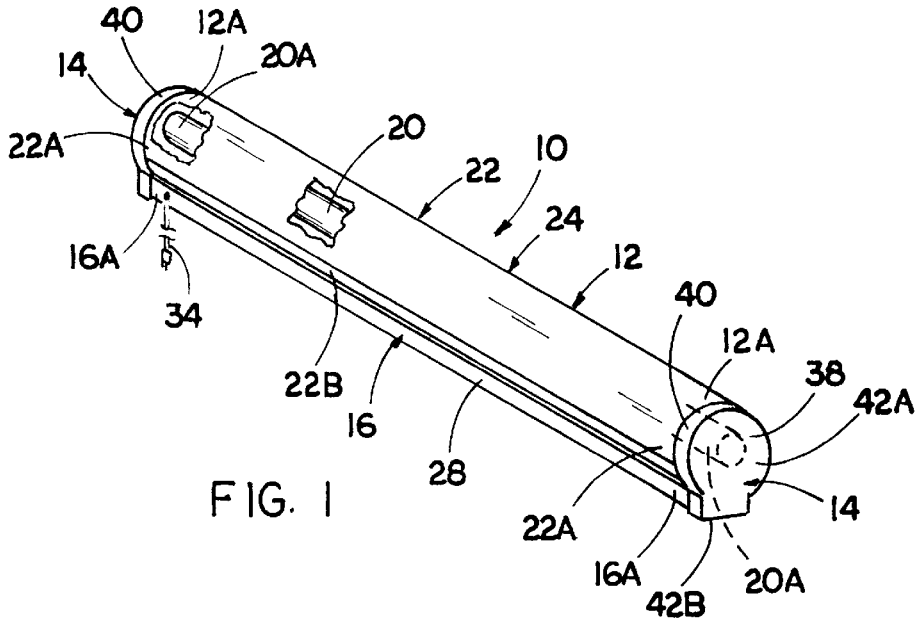
FIG. 1 is a perspective view of a lighting fixture assembly of the present invention having a lighting fixture and a pair of dust covers securably fitted over and sealing opposite ends of the lighting fixture.

In the following description, like reference characters designate like or corresponding parts throughout the several views of the drawings. Also in the following description, it is to be understood that such terms as "forward", "rearward", "left", "right", "upwardly", "downwardly", and the like are words of convenience and are not to be construed as limiting terms.

Figure 2:
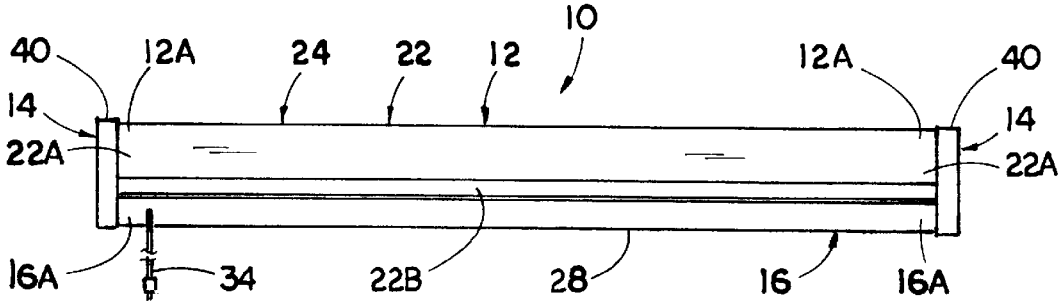
FIG. 2 is a side elevational view of the lighting fixture assembly shown in FIG. 1.
Figure 3:
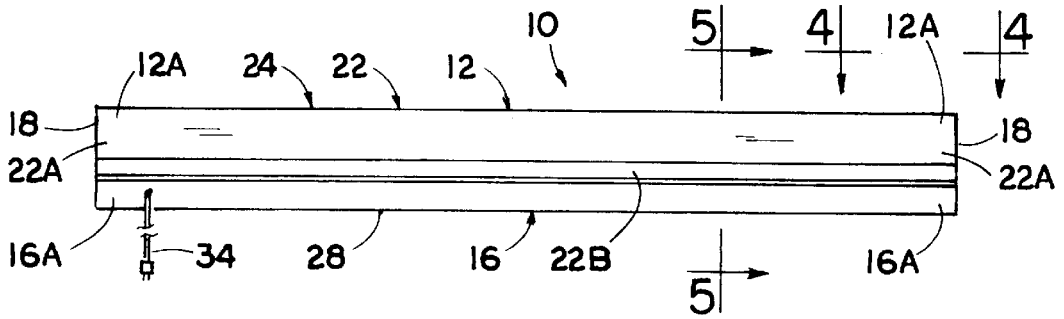
FIG. 3 is a side elevational view of the lighting fixture of the assembly shown in FIG. 1 without the dust covers applied thereto.

Referring to the drawings and particularly to FIGS. 1 and 2, there is illustrated a lighting fixture assembly, generally designated 10, of the present invention. The lighting fixture assembly 10 basically includes a lighting fixture, generally designated 12, which is conventional per se, and at least one and preferably a pair of dust covers 14 securably fittable over for sealing at least one and preferably both opposite ends 12A of the lighting fixture 12 in accordance with the present invention.

Referring to FIGS. 1 to 10, the conventional lighting fixture 12 basically includes a mounting base member 16, a pair of end plates 18, an elongated lamp 20 preferably being of the fluorescent type, and an elongated lens 22. The mounting base member 16 has a pair of opposite ends 16A. Each end plate 18 is mounted to one of the opposite ends 16A of the mounting member 16. The lamp 20 is mounted adjacent to the mounting base member 16 and extends between the opposite end plates 18 and has opposite ends 20A disposed adjacent to the respective end plates 18. The lens 22 is mounted adjacent to the mounting base member 16 and extend between the opposite end plates 18 and has opposite ends 22A disposed adjacent to the respective end plates 18. The lens 22, end plates 18 and mounting base member 16 together form an enclosure 24 substantially enclosing the lamp 20 therein.

Figure 4:
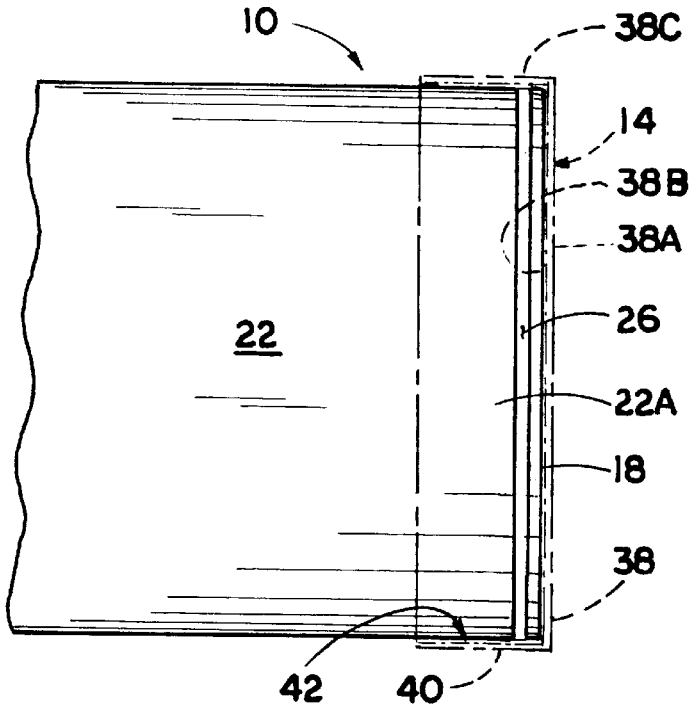
FIG. 4 is an enlarged fragmentary top plan view of the lighting fixture as seen along line 4—4 of FIG. 3 showing a gap between an end of the lens and an end plate of the fixture and with one of the dust covers being shown in dashed line form encompassing and sealing the gap.
Figure 5:
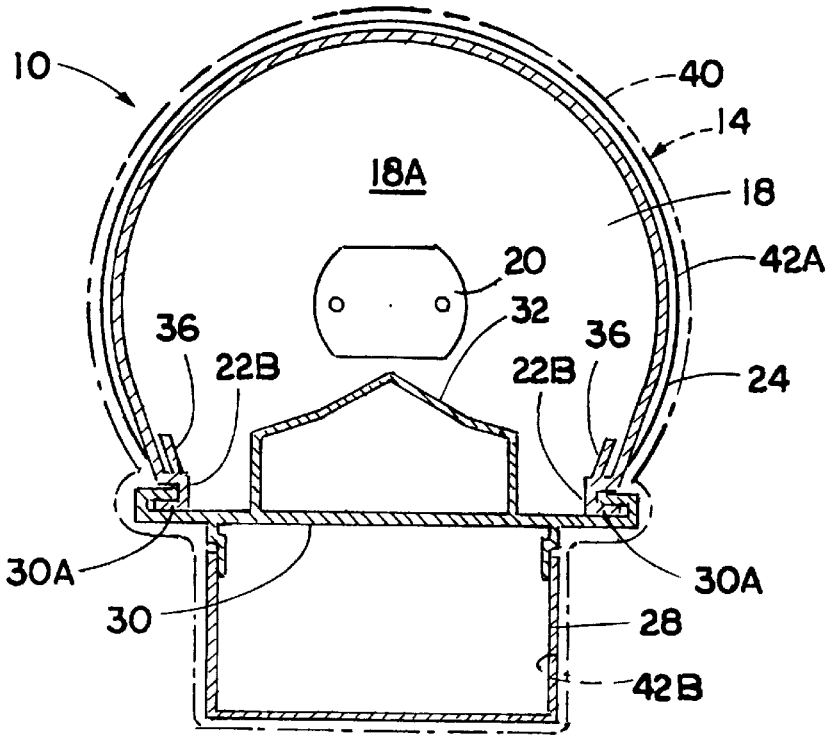
FIG. 5 is an enlarged transverse sectional view of the lighting fixture taken along line 5—5 of FIG. 3 with one of the dust covers being shown in dashed line form.
Figure 6:
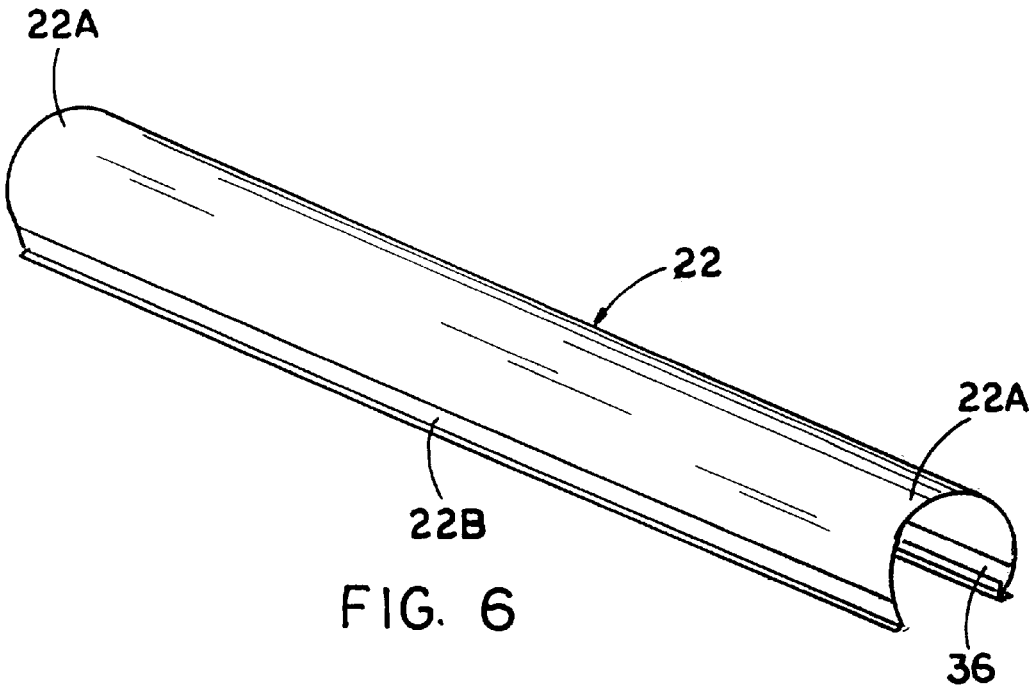
FIG. 6 is an enlarged perspective view of the lens of the lighting fixture.
Figure 7:
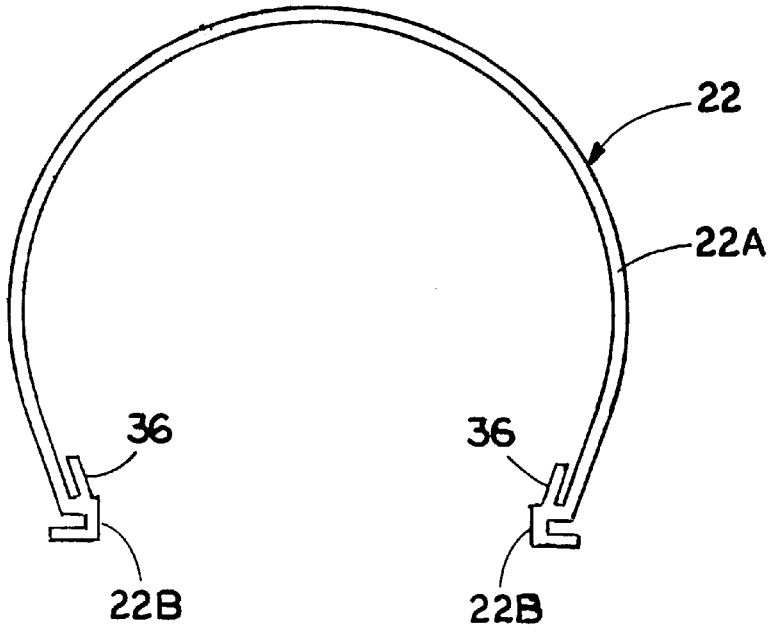
FIG. 7 is an enlarged end elevational view of the lens shown in FIG. 6.
Figure 10:
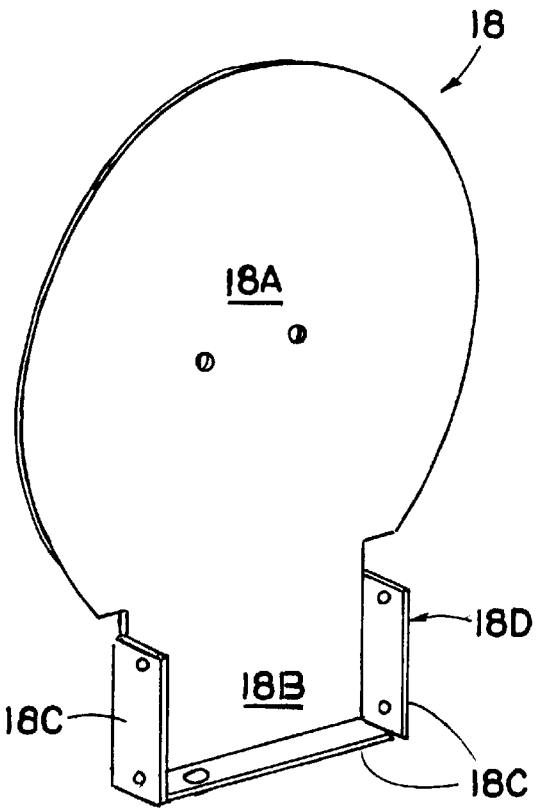
FIG. 10 is a front perspective view of the end plate shown in FIG. 8.
Figure 8:
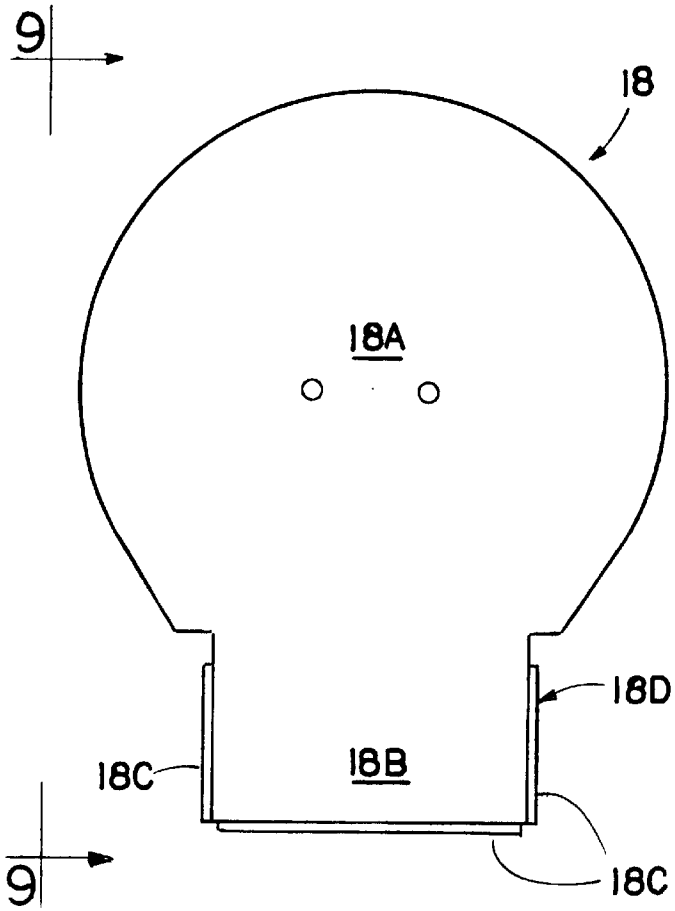
FIG. 8 is an enlarged front elevational view of the end plate of the lighting fixture.
Figure 9:
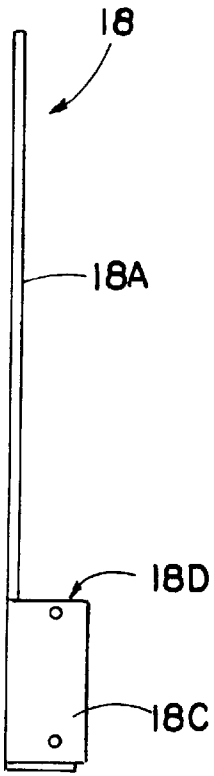
FIG. 9 is a side elevational view of the end plate as seen along line 9—9 of FIG. 8.
Figure 11:
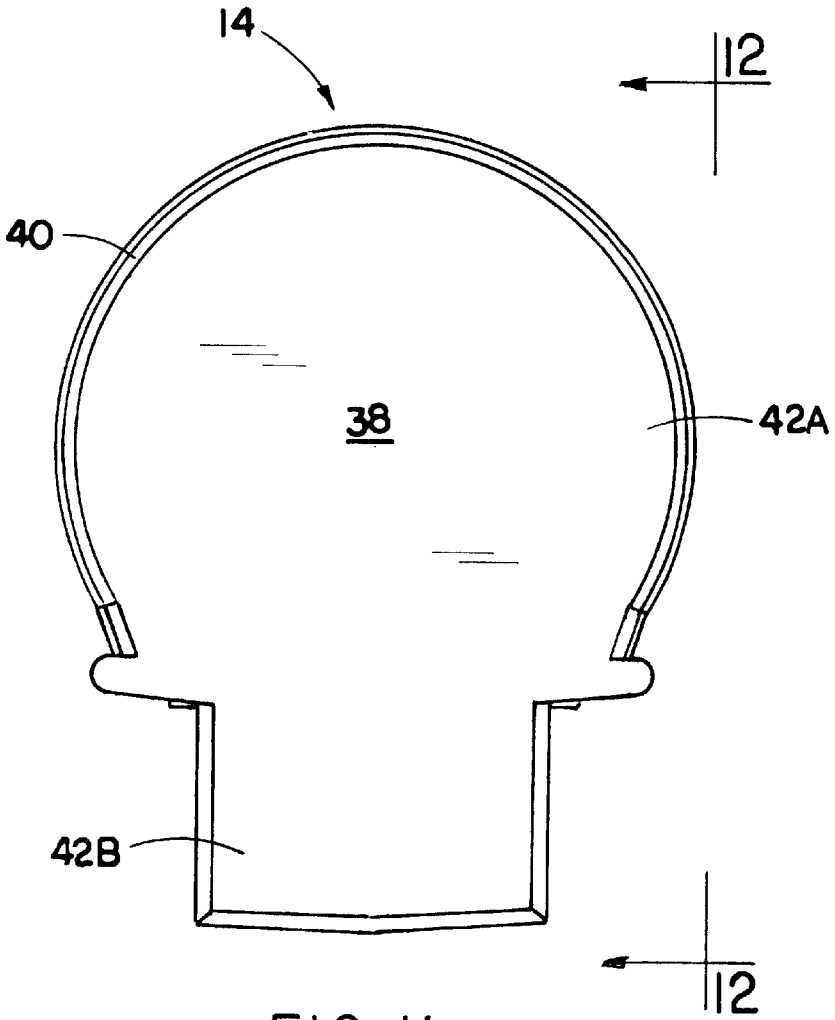
FIG. 11 is an enlarged back elevational view of the dust cover of the lighting fixture assembly.
Figure 12:
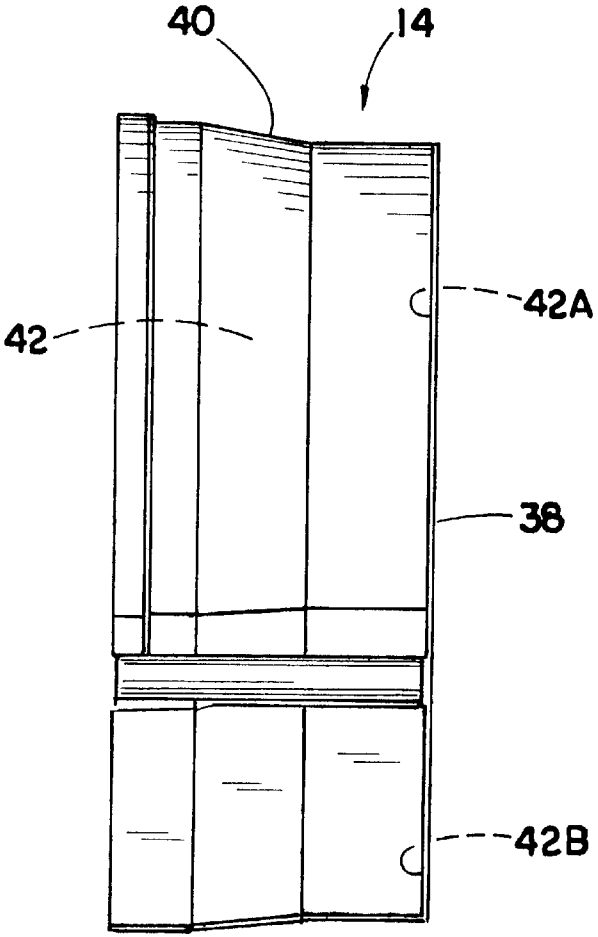
FIG. 12 is a side elevational view of the dust cover as seen along line 12—12 of FIG. 11.

The end plates 18 of the fixture 12 are substantially comprised of a first material, such as a metal, having a first coefficient of thermal expansion, the particular value of which will depend upon the specific metal employed. The lens 22 is substantially comprised of a second material, such as plastic generally and acrylic particularly, having a second coefficient of thermal expansion. The particular value of the second coefficient of thermal expansion will depend upon the specific plastic employed. The second coefficient of thermal different of the second material of the lens 22 is different from the first coefficient of thermal expansion of the first material of the end plates 18 such that, when the lens 22 and end plates 18 are heated during the illumination of the lamp 20, a difference in the thermal expansion of the second material of the lens 22 and the first material of the end plates 18 occurs creating a gap 26 between one of the opposite ends 22A of the lens 22 and one of the end plates 18 corresponding thereto at one of the opposite ends 12A of the lighting fixture 12, as shown in FIG. 4. More likely, gaps 26 are formed between corresponding ones of the opposite ends of the lens 22 and the end plates 18 at both of the opposite ends 12A of the lighting fixture 12. The existence of such gap or gaps 26 permits the infiltration of foreign matter, such as dust, into the enclosure 24.

Referring now to FIGS. 1 to 5, the mounting base member 16 of the lighting fixture 12 is of any suitable conventional type and comprised of a substantially rigid material, such as metal. The mounting member 16 is elongated and has a transverse width and a longitudinal length substantially greater than the transverse width, though need not be so limited. The mounting base member 16 has a bottom channel 28, a base 30 and a light reflector 32. The bottom channel 28, base 30 and light reflector 32 extend the longitudinal length of the mounting base member 16. The base 30 has substantially hook-shaped opposite side edges 30A extending along the longitudinal length of the mounting base member 16. The lighting fixture 12, as is well-known to one of ordinary skill in the art, further includes an electrical connection arrangement (not shown) mounted on the opposite ends of the mounting base member 16 adjacent to the end plates 18 into which the lamp 18 is plugged at its opposite ends. The electrical connection arrangement which includes a conventional ballast and wiring interconnects the lamp 18 with an external power source (not shown) and an electrical switch (not shown) is provided for turning on and off the lamp 18. As well-known the switch can be actuated by pulling on a cord 34 or the like extending from the bottom channel 28 of the mounting base member 16 of the lighting fixture 12.

Referring now to FIGS. 3 to 5 and 8 to 10, each end plate 18 of the lighting fixture 12 is of any suitable conventional type. The first material of the end plate 18 is metal, though need not be so limited. The end plate 18 has a configuration which conforms to that of the opposite ends of the lens 22 and the mounting base member 16. For example, the end plate 18 may be particularly configured in the shape of a mushroom or the like with a substantially circular and larger head portion 18A and a smaller stem or body portion 18B. The head portion 18A abuts an opposite end 22A of the lens 22 whereas the body portion 18B has a set of walls 18C forming a mounting portion 18D which capture and are mounted to one of the opposite ends 16A of the mounting base member 16.

Referring now to FIGS. 1 to 7, the lens 22 of the lighting fixture 12 is of any suitable conventional type and preferably has a substantially cylindrical longitudinal configuration and a substantially inverted U-shaped configuration in transverse cross-section, though need not be so limited, and together with the mounting member 16 and end plates 18 has a first configuration. The transverse cross-sectional size of the lens 22 is substantially greater than the diameter of the lamp 20 such that the lens 22 is spaced radially outwardly from the lamp 20. The lamp 20 and lens 22 substantially extend the longitudinal length of the mounting base member 16. The lens 22 also has hook-shaped opposite longitudinal edges 22B which are complementary to the hook-shaped opposite side edges 30A of the base 30 of the mounting base member 16. The hook-shaped opposite edges 22B extend the longitudinal length of the lens 22 and removably interlock with the hook-shaped opposite side edges 30A of the base 30 such that the lens 22 thereby overlies and substantially surrounds the lamp 20 and with the mounting base member 16 and end plates 18, as mentioned above, form the enclosure 24. The lens 22 further has a pair of fingers 36 extending adjacent to the opposite longitudinal side edges 22B for securing a filter or another lens (not shown) inside the lens 22. The preferred second material of the lens 18 is acrylic, though need not be so limited.

Referring to FIGS. 1, 2, 4, 5,11 and 12, the assembly 10 employs at least one and preferably a pair of the dust covers 14 on the opposite ends 12A of the lighting fixture 12. Each dust cover 14 is comprised of a substantially flexible polymeric material, such as rubber, though need not be so limited. Each dust cover 14 is securably and removably fittable over one of the end plates 18, one of the opposite ends 16A of the mounting base member 16 and one of the opposite ends 22A of the lens 22 for covering the gap 26 which forms therebetween due to the heating of the lens 22 and end plate 18 by the illumination of the lamp 20. The dust covers 14 provide seals at the opposite ends 12A of the lighting fixture 12 at the locations of the gaps 26 so as to prevent foreign matter from entering the lighting fixture assembly 10 through the gaps 26. More particularly, each of the dust covers 14 includes a generally flat main wall 38 having a pair of opposite faces 38A, 38B and a periphery 38C encompassing the faces 38A, 38B, and a substantially continuous flange 40 attached to and extending about the periphery 38C of the main wall 38 and extending away from the inside one 38B of the faces 38A, 38B so as to define a cavity 42 for receiving and capturing therein one of end plates 18, one of the opposite ends 16A of the mounting base member 16 and one of the opposite ends 22A of the lens 22 of the lighting fixture 12.

Each of the dust covers 14 has a second configuration, such as the shape of a mushroom or the like, which conforms to the first configuration of the covered ones of the end plates 18, of the opposite ends 16A of the mounting base member 16 and of the opposite ends 22A of the lens 22. The one end plate 18 fits within the cavity 42 of the dust cover 14 and is in contact with the end wall 38 thereof. One of the opposite ends 22A of the lens 22 is also disposed within the cavity 42, particularly within a head portion 42A thereof. One of the opposite ends 16A of the mounting base member 16 is also disposed within the cavity 42, particularly within a base portion 42B thereof. Each end plate 18 and opposite end 16A, 22A, respectively, of the mounting base member 16 and lens 22 are in this way captured within the dust cover 14 and thereby seal one of the ends 12A of the lighting fixture 12 of the assembly 10.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

What is claimed is:

1. A lighting fixture assembly, comprising:

(a) a lighting fixture including (i) a mounting member having a pair of opposite ends, (ii) a pair of end plates each mounted to one of said opposite ends of said mounting member and being substantially comprised of a first material having a first coefficient of thermal expansion, (iii) an elongated lamp mounted adjacent to said mounting member and extending between said end plates, said lamp having opposite ends disposed adjacent to said end plates, and (iv) an elongated lens mounted adjacent to said mounting member and extending between said end plates, said lens having opposite ends disposed adjacent to said end plates and together with said mounting member and end plates substantially enclosing said lamp, said lens being substantially comprised of a second material having a second coefficient of thermal expansion different from said first coefficient of thermal expansion of said first material of said end plates such that when said lens and end plates are heated during illumination of said lamp a difference in expansion of said second material of said lens and said first material of said end plates occurs creating respective gaps between said opposite ends of said elongated lens and said end plates; and (b) a pair of dust covers each securably fittable over at least one of said end plates, one of said opposite ends of said mounting member and one of said opposite ends of said lens for covering said gaps therebetween and thereby sealing said assembly at the locations of said gaps to prevent foreign matter from entering said assembly through said gaps, each of said dust covers including a main wall having a pair of opposite faces and a periphery encompassing said faces, and a flange attached to and extending about said periphery of said main wall and extending away from one of said faces thereof so as to define a cavity for receiving therein one of said end plates, one of said opposite ends of said mounting member and one of said opposite ends of said lens of said lighting fixture.

2. The assembly as recited in claim 1, wherein said first material of said end plate is metal.

3. The assembly as recited in claim 1, wherein said second material of said lens is plastic.

4. The assembly as recited in claim 1, wherein each of said dust covers is comprised of a substantially flexible polymeric material.

5. The assembly as recited in claim 4, wherein said polymeric material of each of said dust covers is rubber.

6. The assembly as recited in claim 1, wherein:

each of said end plates, each of said opposite ends of said mounting member and each of said opposite ends of said lens together have a first configuration; and each of said dust covers has a second configuration conforming to said first configuration.

7. A lighting fixture assembly, comprising:

(a) a lighting fixture including (i) a mounting member having a pair of opposite ends, (ii) a pair of end plates each mounted to one of said opposite ends of said mounting member and being substantially comprised of a first material having a first coefficient of thermal expansion, (iii) an elongated lamp mounted adjacent to said mounting member and extending between said end plates, said lamp having opposite ends disposed adjacent to said end plates, and (iv) an elongated lens mounted adjacent to said mounting member and extending between said end plates, said lens having opposite ends disposed adjacent to said end plates and together with said mounting member and end plates substantially enclosing said lamp, said lens being substantially comprised of a second material having a second coefficient of thermal expansion different from said first coefficient of thermal expansion of said first material of said end plates such that when said lens and end plates are heated during illumination of said lamp a difference in expansion of said second material of said lens and said first material of said end plates occurs creating respective gaps between said opposite ends of said elongated lens and said end plates; and (b) a pair of dust covers each securably fittable over at least one of said end plates, one of said opposite ends of said mounting member and one of said opposite ends of said lens for covering said gaps therebetween and thereby sealing said assembly at the locations of said gaps to prevent foreign matter from entering said assembly through said gaps, each of said dust covers including (i) a main wall having a pair of opposite faces and a periphery encompassing said faces, and (ii) a flange attached to and extending about said periphery of said main wall and extending away from one of said faces thereof so as to define a cavity for receiving therein one of said end plates, one of said opposite ends of said mounting member and one of said opposite ends of said lens of said lighting fixture;

(c) each of said end plates, each of said opposite ends of said mounting member and each of said opposite ends of said lens together have a first configuration, each of said dust covers has a second configuration conforming to said first configuration, each of said dust covers being comprised of rubber.

8. The assembly as recited in claim 7, wherein said first material of each of said end plates is metal.

9. The assembly as recited in claim 7, wherein said second material of said lens is plastic.

10. The assembly as recited in claim 7, wherein each of said dust covers is comprised of a substantially flexible polymeric material.

11. The assembly as recited in claim 10, wherein said polymeric material of each of said dust covers is rubber.

12. The assembly as recited in claim 7, wherein each of said dust covers is comprised of rubber.

* * * * *